US009814274B2

(12) United States Patent
Maier

(10) Patent No.: US 9,814,274 B2
(45) Date of Patent: Nov. 14, 2017

(54) CYCLING JERSEY

(71) Applicant: ASSOS OF SWITZERLAND GmbH, San Pietro di Stabio (CH)

(72) Inventor: Roger Maier, Carona (CH)

(73) Assignee: ASSOS OF SWITZERLAND GMBH, San Pietro di Stabio (CH)

( * ) Notice: Subject to any disclaimer, the term of this patent is extended or adjusted under 35 U.S.C. 154(b) by 0 days.

(21) Appl. No.: 15/093,271

(22) Filed: Apr. 7, 2016

(65) Prior Publication Data

US 2016/0331047 A1 Nov. 17, 2016

(30) Foreign Application Priority Data

May 13, 2015 (EP) ..... 15167596

(51) Int. Cl.

| | |
|---|---|
| ***A41D 13/00*** | (2006.01) |
| ***A41D 27/04*** | (2006.01) |
| ***A41D 27/02*** | (2006.01) |
| ***A41D 1/04*** | (2006.01) |
| ***A41D 3/00*** | (2006.01) |
| ***A41D 31/02*** | (2006.01) |

(52) U.S. Cl.

CPC ..... *A41D 13/0015* (2013.01); *A41D 1/04* (2013.01); *A41D 3/00* (2013.01); *A41D 27/02* (2013.01); *A41D 27/04* (2013.01); *A41D 31/02* (2013.01); *A41D 2400/22* (2013.01); *A41D 2400/60* (2013.01); *A41D 2600/104* (2013.01)

(58) Field of Classification Search

CPC ..... A41D 27/04; A41D 13/0012; A41D 1/04; A41B 1/00

USPC ..... 2/97, 115, 94, 102, DIG. 1

See application file for complete search history.

(56) References Cited

U.S. PATENT DOCUMENTS

| | | | | |
|---|---|---|---|---|
| 2,443,447 | A * | 6/1948 | Falcon | A41D 1/02 2/93 |
| 2,846,686 | A * | 8/1958 | Tames | A41D 13/1209 2/114 |
| 5,105,478 | A * | 4/1992 | Pyc | A41D 27/28 2/106 |
| 5,218,720 | A * | 6/1993 | Tolton | A41D 1/04 2/102 |
| 5,526,532 | A | 6/1996 | Willard | |
| 6,263,511 | B1 | 7/2001 | Polegato | |
| 7,043,767 | B2 * | 5/2006 | Jaeger | A41D 27/28 2/87 |
| 7,581,258 | B2 * | 9/2009 | Baron | A41D 31/0033 2/168 |
| 2004/0132367 | A1 | 7/2004 | Rock | |

(Continued)

FOREIGN PATENT DOCUMENTS

| | | | |
|---|---|---|---|
| CA | 2370620 | A1 | 7/2003 |
| DE | 202009006041 | U1 | 7/2009 |

OTHER PUBLICATIONS

European Search Report from EP 15167596 dated Nov. 24, 2015.

*Primary Examiner* — Tejash Patel

(74) *Attorney, Agent, or Firm* — Fox Rothschild LLP

(57) ABSTRACT

A cycling garment, said garment being a jersey, a jacket or a vest having a structure realized with an outer fabric layer and further comprising an inner fabric layer having different breathability properties from the outer layer, wherein the inner layer is internally joined to the outer layer and forms an inner lining of at least part of said cycling garment.

8 Claims, 1 Drawing Sheet

(56) References Cited

U.S. PATENT DOCUMENTS

| | | | | |
|---|---|---|---|---|
| 2006/0085886 | A1* | 4/2006 | Williams | A41D 27/13 2/53 |
| 2007/0006360 | A1 | 1/2007 | Walker | |
| 2013/0298306 | A1* | 11/2013 | Turner | A41D 1/08 2/115 |
| 2014/0109285 | A1* | 4/2014 | Amarasiriwardena | A41B 1/08 2/69 |

* cited by examiner

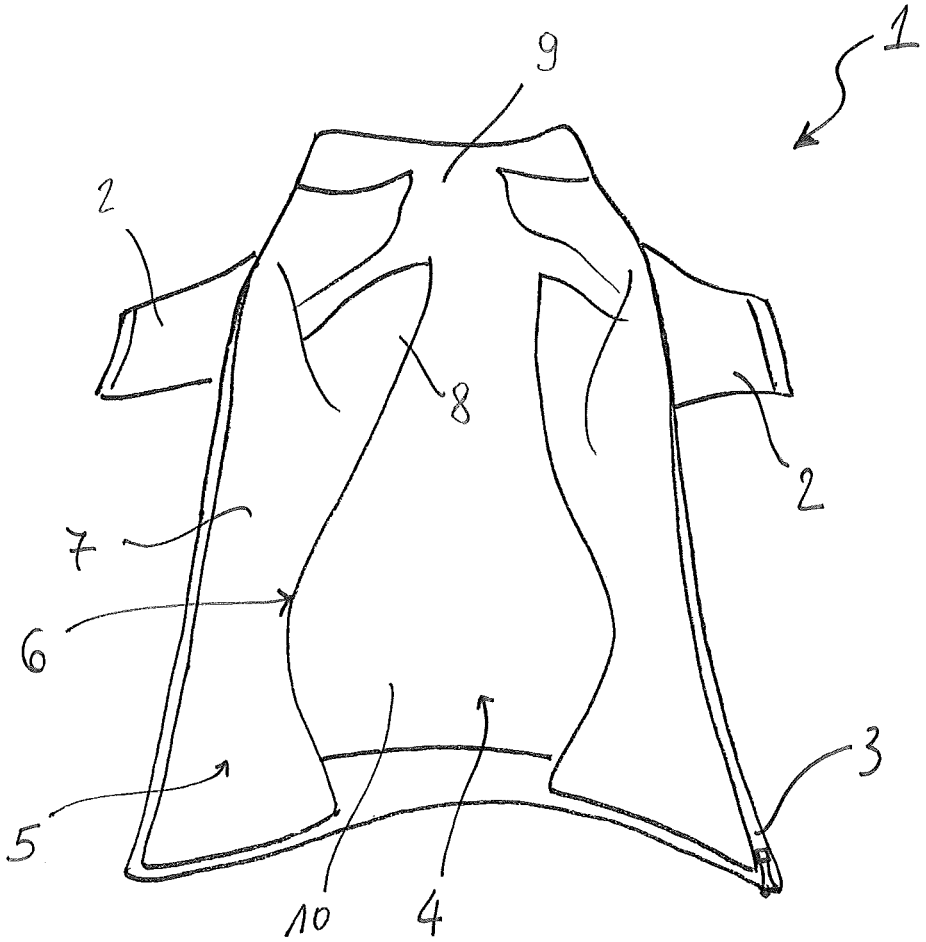
1
9
2
8
2
7
6
3
5
10
4

CYCLING JERSEY

CROSS REFERENCE TO RELATED APPLICATIONS

This U.S. Application claims priority to European Application No.: 15167596.4 filed May 13, 2015, entitled "A CYCLING JERSEY" the entirety of which is incorporated herein by reference.

FIELD OF APPLICATION

The present invention relates to the field of cycling garments, in particular to a cycling jersey.

PRIOR ART

Cycling garments are made in different versions for use under different climatic conditions. A cycling garment, in particular a jersey, a jacket or a vest, is required to shield from atmospheric agents and at the same time to keep the rider fresh and comfortable under intense effort. The known garments specifically designed for cycling have a single-layer structure made of a material suitable to ensure protection from outside elements, which however is not suitable to directly contact the skin, having poor breathability and poor permeability. In sports clothing, especially in the field of aerobic sports such as cycling, the layer in contact with the skin is commonly termed base layer and is regarded as being of great importance. In particular, the base layer must be able to provide thermal comfort and to transport the sweat (water vapour) away from the body, so that it is continuously removed.

For example a conventional summer jersey is generally designed to be light and at the same time to protect from outside elements, but is not able to satisfy the above requirement of efficient removal of sweat from the user's body. Accumulation of sweat is a source of discomfort and decreased performance. In addition, the rider is exposed to intense cooling due to the external air contacting the wet jersey, which is a further source of discomfort. The part of the body which is most exposed to said cooling is the torso having a large surface area directly exposed to the air and having a high sensitivity to the cold.

In order to deal with the above problems, the solution which is commonly employed by cyclists is the use of an underwear underneath the sports jersey. The underwear is generally expected to transport the sweat out of the body keeping the outer jersey dry.

However, this solution does not allow obtain the best results. The performances of a high-end technical garment may be negatively affected by an underwear of a lower quality and/or made of a wrong material. This happens in particular when the properties of the underwear (e.g. elasticity, breathability, etc.) do not properly match the properties of the garment. For example, underwear with different elasticity from the outer garment will react differently to the riding, forming creases or wrinkles which may rub against the cyclist's skin causing discomfort or pain and may also degrade some features of the outer garment, such as the skin-tightness and aerodynamics. Furthermore, the solution of underwear plus outer jersey is unpractical due to the use of two pieces of clothing.

SUMMARY OF THE INVENTION

The object of the invention is to provide a solution to the aforementioned problems of the prior art.

The idea forming the basis of the invention is to provide a cycling jersey having an inner lining adapted to act as integrated base layer, being in direct contact with the skin, and being able to transport the sweat out of the body and to ensure an excellent fit and suitable thermal protection.

The object is achieved by means of a cycling garment, said garment being a jersey, a jacket or a vest having a structure realized with an outer fabric layer and further comprising an inner fabric layer having different breathability properties from the outer layer, wherein the inner layer is internally joined to the outer layer and forms an inner lining of at least part of said cycling garment.

Hereinafter, for the sake of simplicity, the term "jersey" will be used, although the invention is to be understood as referring in a more general way to a jersey, a jacket or a vest.

The inner layer is permanently fixed to the outer layer. Preferably, the inner layer is stitched with the inside of the outer layer.

In some embodiments, the inner layer covers only selected portions of the jersey. Hence an advantage of the invention is that the inner layer is strategically located where the need of a base layer is greater. Accordingly the best compromise between lightness and performance is reached. More preferably, said inner layer is provided to internally line the front portion and the side portions of the outer layer. As a consequence, during the use said inner layer covers the torso of the cyclist (i.e. the front part of the body) and the areas extending between the hips and the underarms (i.e. the lateral parts of the body) which are the body parts exposed to intense sweat and which need be protected from outside elements, e.g. from wind, rain, etc. The applicant has found that lining of the above body parts provides the best effect while lining of the back can be avoided. It can be noted that the inner layer (base layer) is located where specifically required, which is an advantage of the invention.

Preferably said inner layer has greater breathability than the outer layer. In accordance, the skin-contacting inner layer is able to provide greater transportation of the sweat out of the body.

Different breathability properties between the two layers may be obtained with different fabrics or also with the same fabric having different thickness and/or subjected to different processing.

Even more preferably, said layers are made of fabrics having proper affinity so as to adhere to each other without forming creases or wrinkles and so as sweat may be efficiently transported from the inner layer to the outer layer.

Preferably said layers have the same or similar elasticity coefficient. The layers with a similar elasticity can remain perfectly skin-tight on the cyclist's body and eliminate the problem of creases due to poorly compatible fabrics of different pieces of clothing.

More preferably the inner layer intended to contact the skin is made of a polypropylene-based material. The outer layer intended to act as barrier against the atmospheric agent is made preferably of a more resistant material, for example a polyamide/elastane or polyester/elastane-based mixture.

Preferably, the inner layer is realized with a mesh fabric which is able to ensure the required breathability and permeability properties.

The great advantage of the invention is that the skin-contacting base layer is integrated in the jersey. Instead of the prior-art single-layer construction, the invention provides a double-layer construction where the outer layer is doubled with an inner base layer and the base layer is distributed in places where the removal of the sweat is of crucial importance. Then, the jersey according to the invention is able to efficiently remove sweat, to keep the user's skin dry and the temperature constant under intense effort, to ensure perfect skin-tightness as required to reach the maximum performance. The ability to remove sweat and transport it out of the body is also termed "wicking". The inner layer also provides optimum thermal protection, which is concentrated where necessary, in particular over the torso. Another advantage of the jersey according to the invention is greater comfort and a more practical use due to wearing a single garment without the need of underwear.

Further characteristics and advantages of the present invention shall become clearer from the following description of a preferred embodiment thereof, with reference to FIG. 1 which illustrates a preferred embodiment of a cycling jersey according to the invention.

DETAILED DESCRIPTION OF A PREFERRED EMBODIMENT

FIG. 1 shows an open cycling jersey 1 with short sleeves 2 and a front zip fastener 3. The jersey 1 is a short-sleeved jersey for summer use, this being however not limiting for the invention.

The jersey 1 has a structure made of an outer fabric layer 4 and an inner fabric layer 5 to act as base layer.

The inner layer 5 is stitched by means of seams 6 on the inside of the outer layer 4.

The inner layer 5 partially lines the inside of the outer layer 4. In the example of the FIGURE, said inner layer 5 comprises a torso portion 7 and side portions 8. When the jersey 1 is worn, the side portions 8 extend between the hips and the underarms and wrap around the side part of the torso and of the back of the user. On the contrary, the collar portion 9, the sleeve portions 2 and the back portion 10 are not internally lined with said inner layer 4.

The outer layer 4 of the jersey is made from a suitable elasticised fabric, for example polyamide or polyester mixed with elastane, preferably of greater resistance than the fabric used for the inner layer 5. Said inner layer 5 is for example realized with mesh fabric of polypropylene, which provides the inner layer 5 with higher breathability than the outer layer 4, so as to be suitable for direct contact with the skin (base layer).

The invention thus achieves the objects mentioned above, providing a garment particularly suitable for use under intense effort.

The invention claimed is:

1. A cycling garment, said garment being a jersey, a jacket or a vest (1) having a structure realized with an outer fabric layer (4) and further comprising an inner fabric layer (5) having different breathability properties from the outer layer, wherein the inner layer is internally joined to the outer layer and forms an inner lining of a part of said cycling garment, wherein said inner layer (5) is arranged to line only a front portion (7) and side portions (8) of the outer layer.

2. The cycling garment according to claim 1, wherein said inner layer (5) is permanently fixed to the outer layer.

3. The cycling garment according to claim 1, wherein said inner layer (5) is a base layer suitable for contact with the skin.

4. The cycling garment according to claim 1, wherein said outer layer and inner layer are made of fabrics having proper affinity so as to adhere to each other without forming creases or wrinkles.

5. The cycling garment according to claim 4, wherein elasticity coefficients of the outer layer and the inner layer are equal or substantially equal.

6. A cycling garment according to claim 5, wherein the inner layer (5) is made of a mesh fabric.

7. A cycling garment according to claim 6, wherein said inner layer is made of a polypropylene-based material.

8. A cycling garment according to claim 7, wherein said outer layer is made of a polyamide/elastane or polyester/elastane-based mixture.

* * * * *